US010279226B2

(12) United States Patent
Ban

(10) Patent No.: US 10,279,226 B2
(45) Date of Patent: May 7, 2019

(54) GOLF CLUB HEAD

(71) Applicant: Bridgestone Sports Co., Ltd., Tokyo (JP)

(72) Inventor: Wataru Ban, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/928,260

(22) Filed: Mar. 22, 2018

(65) Prior Publication Data

US 2018/0369657 A1 Dec. 27, 2018

(30) Foreign Application Priority Data

Jun. 21, 2017 (JP) ..... 2017-121720

(51) Int. Cl.
*A63B 53/04* (2015.01)

(52) U.S. Cl.
CPC ..... *A63B 53/047* (2013.01); *A63B 53/04* (2013.01); *A63B 2053/0408* (2013.01); *A63B 2053/0416* (2013.01); *A63B 2053/0445* (2013.01)

(58) Field of Classification Search
CPC .... A63B 2053/0445; A63B 2053/0416; A63B 53/047; A63B 2053/0408; A63B 53/04
USPC ..... 473/331, 330
See application file for complete search history.

(56) References Cited

U.S. PATENT DOCUMENTS

| | | | | |
|---|---|---|---|---|
| 5,354,059 | A * | 10/1994 | Stuff | A63B 53/04 473/329 |
| 6,309,310 | B1 * | 10/2001 | Shira | A63B 53/04 473/331 |
| 8,979,670 | B2 | 3/2015 | Aguayo et al. | |
| 9,308,422 | B2 | 4/2016 | Ripp et al. | |
| 9,889,353 | B2 * | 2/2018 | Philip | A63B 53/0487 |
| 2006/0025233 | A1 | 2/2006 | Lin | |
| 2011/0269567 | A1 * | 11/2011 | Ban | A63B 53/047 473/331 |
| 2016/0346649 | A1 * | 12/2016 | Jertson | A63B 53/0487 |

FOREIGN PATENT DOCUMENTS

| | | | |
|---|---|---|---|
| JP | 2011-056099 | A | 3/2011 |
| JP | 4946158 | B2 | 6/2012 |
| JP | 4946160 | B2 | 6/2012 |
| JP | 2015-107227 | A | 6/2015 |

* cited by examiner

*Primary Examiner* — Benjamin Layno
(74) *Attorney, Agent, or Firm* — Sughrue Mion, PLLC

(57) ABSTRACT

A golf club head including a face portion includes a plurality of score lines formed on the face portion, a plurality of first grooves formed on the face portion, and a plurality of second grooves formed on the face portion. The first grooves have a depth D1 and a width W1 that is in a direction orthogonal to a direction in which the first grooves extend, the second grooves have a depth D2 and a width W2 that is in a direction orthogonal to a direction in which the second grooves extend, W1>D1, and W2<D2.

6 Claims, 7 Drawing Sheets

GOLF CLUB HEAD

BACKGROUND OF THE INVENTION

Field of the Invention

The present invention relates to a golf club head.

Description of the Related Art

Golf club heads in which unevenness or grooves finer than the score lines are formed on the face portion have been proposed (for example, US-2011-269567, Japanese Patent Laid-Open No. 2015-107227, Japanese Patent No. 4946158, Japanese Patent No. 4946160, U.S. Pat. No. 8,979,670, U.S. Pat. No. 9,308,422, Japanese Patent Laid-Open No. 2011-056099, and US-2006-025233). Such grooves or the like are effective in increasing the amount of spin on the ball or preventing a reduction of the amount of spin at times such as in wet weather.

However, conventional golf club heads have room for improvement in terms of drainage on the face portion and the amount of spin on the ball.

SUMMARY OF THE INVENTION

It is an object of the present invention to achieve improvement in drainage on the face portion and in the amount of spin on the ball.

According to an aspect of the present invention, a golf club head is provided with a plurality of score lines formed on the face portion, a plurality of first grooves formed on the face portion, and a plurality of second grooves formed on the face portion, the first grooves having a depth D1 and a width W1 that is in a direction orthogonal to a direction in which the first grooves extend, the second grooves having a depth D2 and a width W2 that is in a direction orthogonal to a direction in which the second grooves extend, W1>D1, and W2<D2.

Further features of the present invention will become apparent from the following description of exemplary embodiments (with reference to the attached drawings).

DESCRIPTION OF THE EMBODIMENTS

Figure 1:
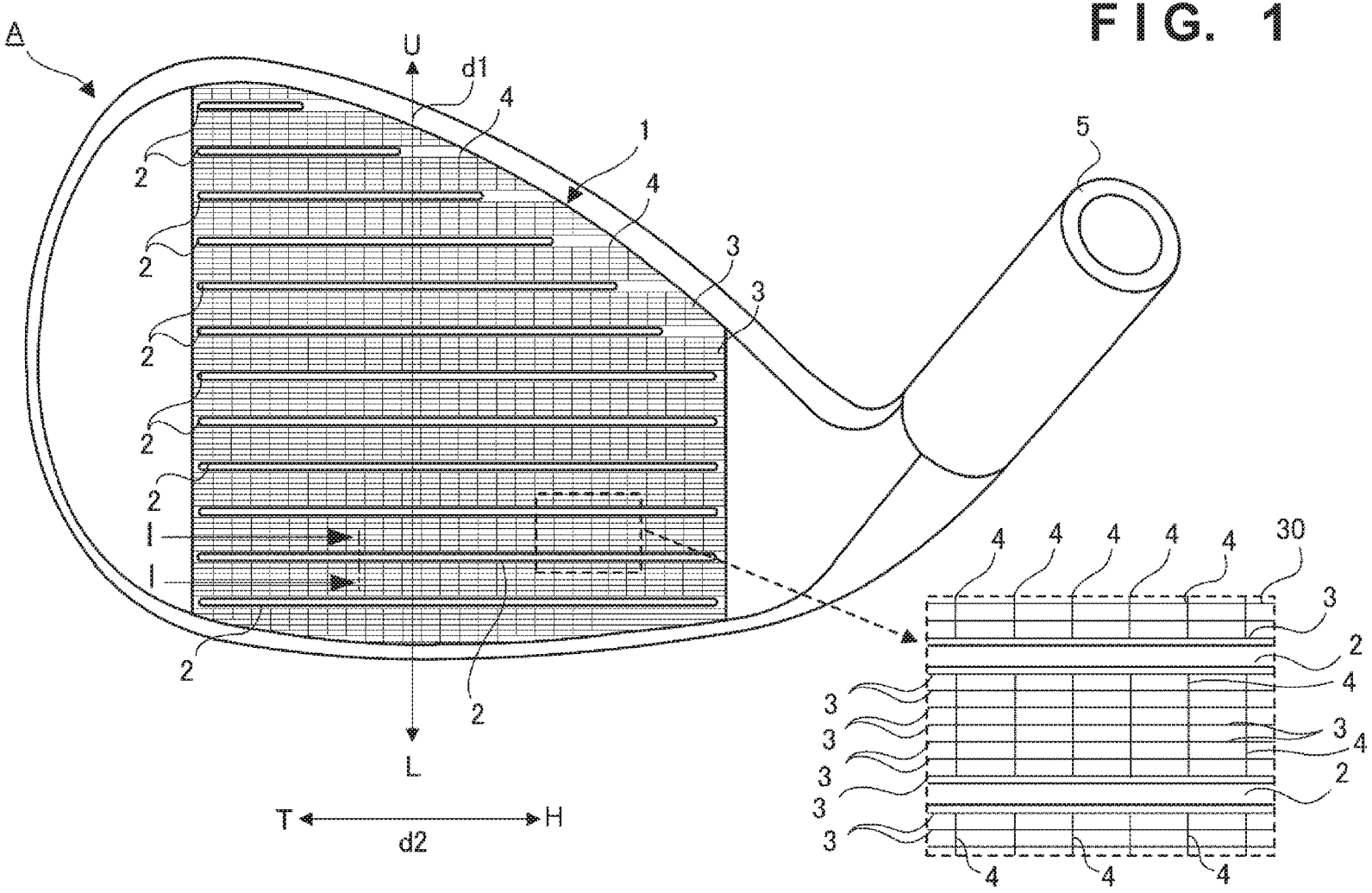
FIG. 1 is an external view and a partial enlarged view of a golf club head according to one embodiment of the present invention.

FIG. 1 is an external view and a partial enlarged view of a golf club head A according to one embodiment of the present invention. The example of FIG. 1 shows an example in which the present invention is applied to an iron-type golf club head. The present invention is suitable for iron-type golf club heads, particularly middle iron, short iron and wedge-type golf club heads. Specifically, the present invention is suitable for the manufacture of golf club heads having a loft angle from 30 degrees to 70 degrees inclusive and a head weight from 240 g to 320 g inclusive. However, the present invention is also applicable to wood-type and utility-type (hybrid-type) golf club heads.

The golf club head A is provided with a face portion 1 and a hosel portion 5. The face portion 1 forms a striking face that strikes the golf ball. A shaft which is not shown is mounted in the hosel portion 5. In FIG. 1, an arrow d2 indicates a toe-heel direction, with T indicating the toe side and H indicating the heel side. An arrow d1 indicates a direction that is orthogonal to the toe-heel direction and follows the striking face. U indicates the upper side when the sole portion of the head A is grounded, and L indicates the lower side when the sole portion of the head A is grounded.

A plurality of score lines 2, a plurality of grooves 3 and a plurality of grooves 4 are formed on the face portion 1. The plurality of grooves 3 and grooves 4 are grooves having different dimensions to the score lines 2, and, in the case of the present embodiment, are grooves that are narrower than the score lines 2. Hereinafter, the grooves 3 and the grooves 4 may be referred to as fine grooves 3 and fine grooves 4.

Figure 2:
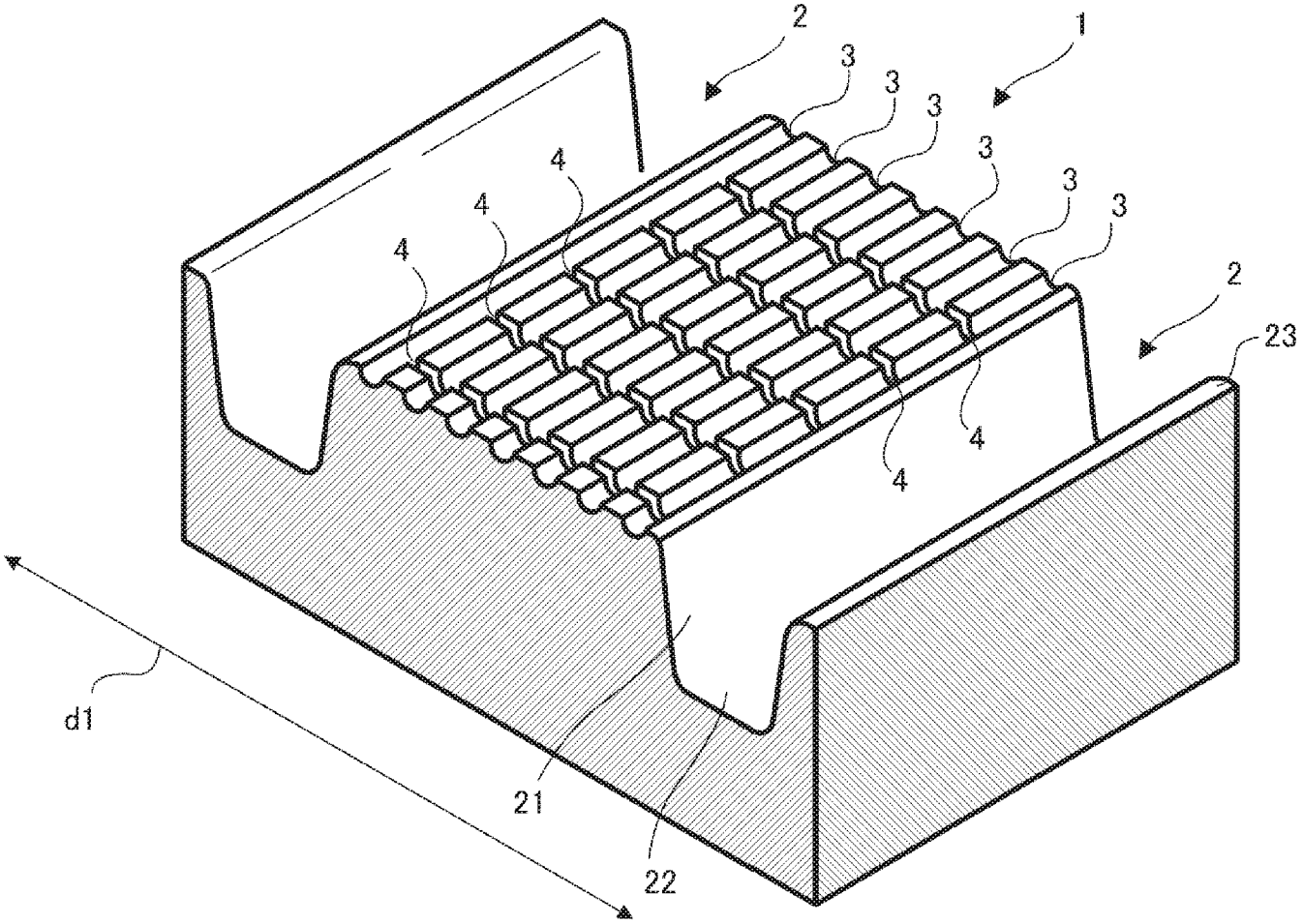
FIG. 2 is a partial cross-sectional perspective view of the golf club head of FIG. 1.
Figure 3A:
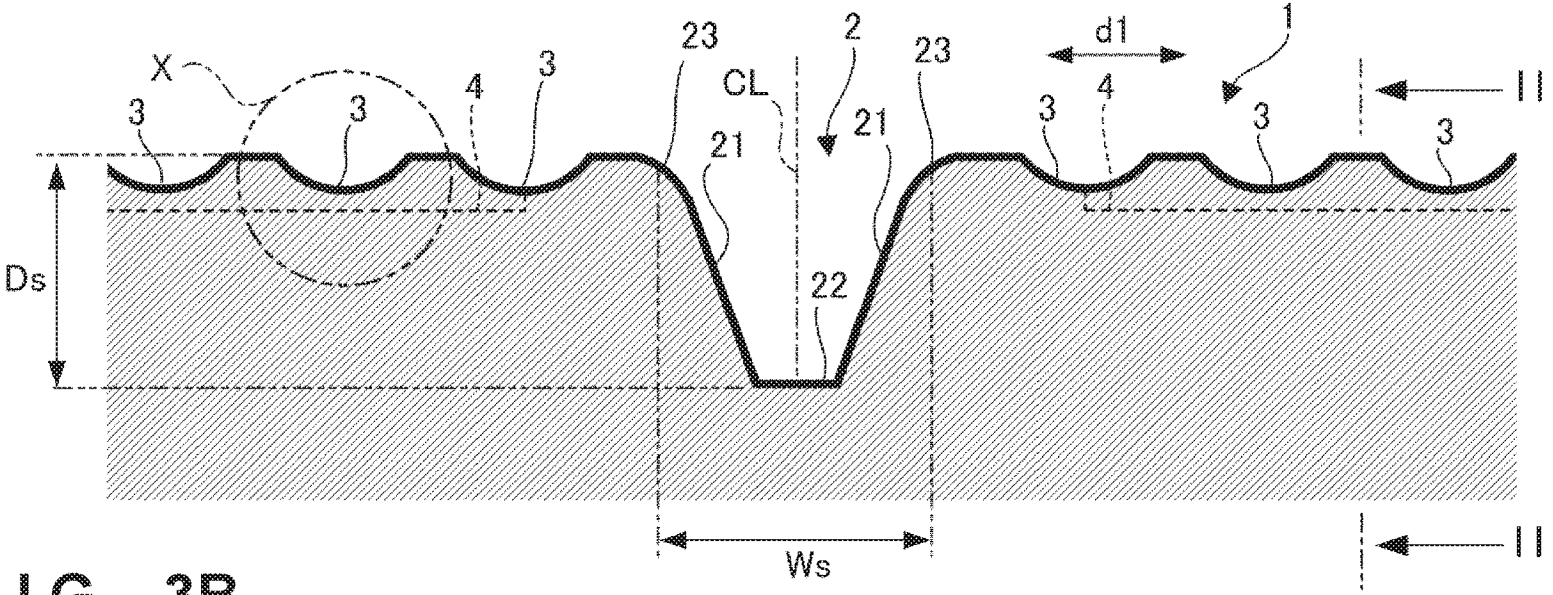
FIGS. 3A and 3B are cross-sectional views of the golf club head of FIG. 1.
Figure 3B:
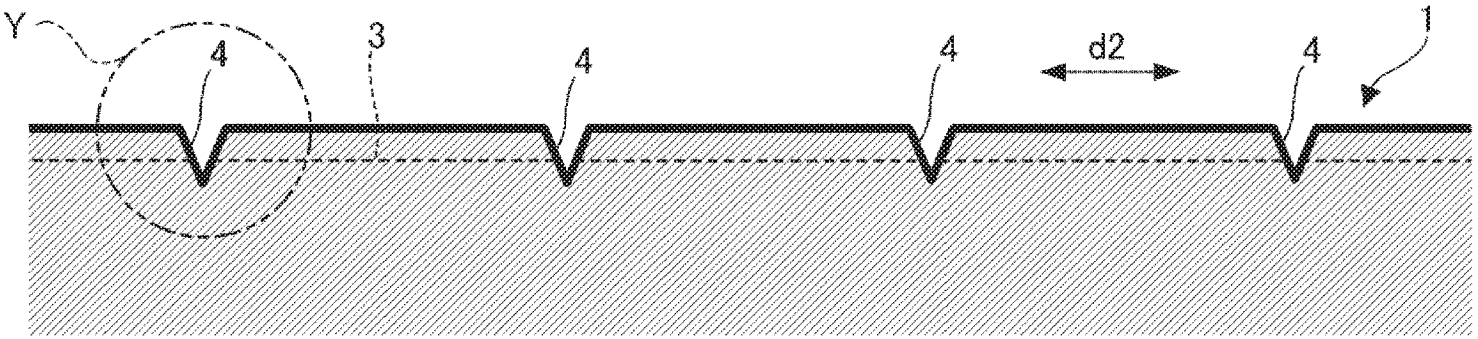
Figure 4A:
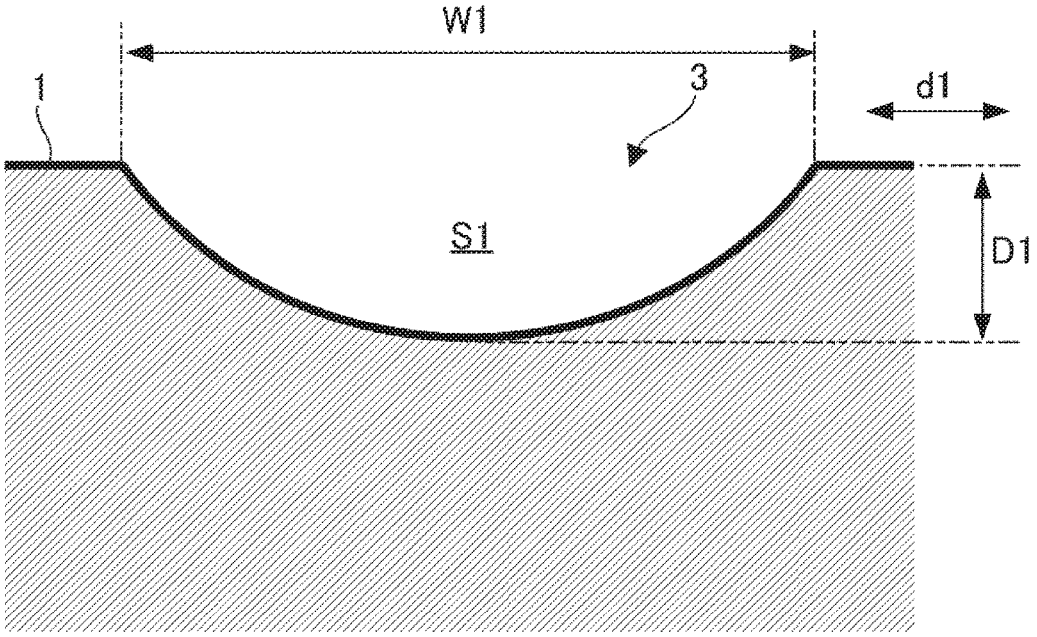
FIG. 4A is an enlarged view of an X portion of FIG. 3A.
Figure 4B:
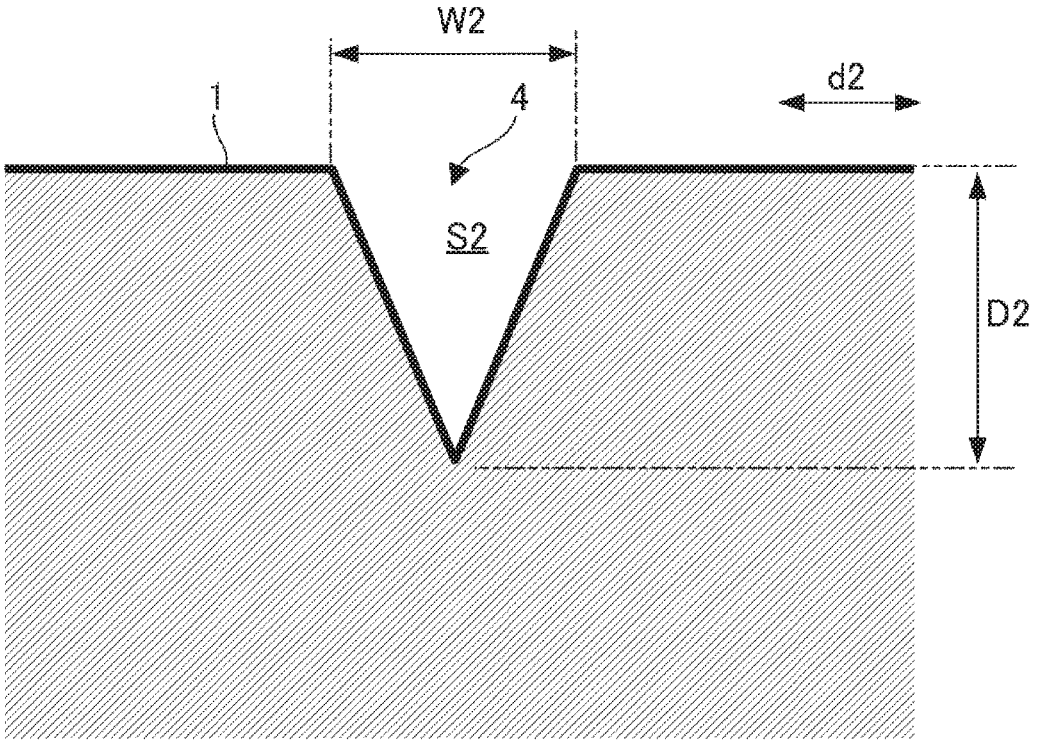
FIG. 4B is an enlarged view of a Y portion of FIG. 3B.

The score lines 2, the fine grooves 3 and the fine grooves 4 will be described with reference to FIGS. 1 to 4B. FIG. 2 is a partial cross-sectional perspective view of the golf club head A, and shows part of the face portion 1 cut at cross sections in a d1 direction and a d2 direction. FIG. 3A is a cross-sectional view of the golf club head A along a line I-I in FIG. 1, and FIG. 3B is a cross-sectional view of the golf club head A along a line II-II in FIG. 3A. FIG. 4A is an enlarged view of an X portion of FIG. 3A, and FIG. 4B is an enlarged view of a Y portion of FIG. 3B.

A plurality of score lines 2 are disposed parallel to each other in the d1 direction. Each of the score lines 2 is a linear groove extending in the d2 direction. In the case of the present embodiment, the interval (pitch) at which the individual score lines 2 are disposed is a regular interval (equal pitch), but the score lines may be arranged at different pitches. In the present embodiment, the cross-sectional shape of the score lines 2 is the same, except for both end portions (toe side end portion, heel side end portion) in the longitudinal direction. Also, the individual score lines 2 have the same cross-sectional shape.

The score lines 2 each have a pair of side walls (side portions) 21 and bottom walls (bottom portions) 22, and the cross-sectional shape thereof is formed to be a symmetrical trapezoid with respect to a central line in the d1 direction. Note that the cross-sectional shape of the score lines 2 is not limited to being trapezoidal, and may be other shapes, such as V-shaped. Edge portions 23 of the score lines 2 are rounded. The radius of the rounding is from 0.05 mm to 0.3 mm inclusive.

A depth (distance between the bottom wall 22 and the surface of the face portion 1) Ds of the score lines 2 is preferably 0.3 mm or more. In the case where the golf club head A is for competitive use, the depth Ds is set to 0.5 mm or less in terms of complying with the rules. A width (width obtained by the 30-degree measurement method) Ws of the score lines 2 is preferably 0.6 mm or more. In the case where the golf club head A is for competitive use, the width Ws is set to 0.9 mm or less in terms of complying with the rules.

The fine grooves 3 and the fine grooves 4 are grooves that are smaller in width (W1, W2) and depth (D1, D2) than the score lines 2, and are formed in each area between adjacent score lines 2. In the case of the present embodiment, the fine grooves 3 are linear grooves extending in the d2 direction, and are formed parallel to the score lines 2. Here, the fine grooves 3 and the score lines 2 being parallel may include the angle of intersection of infinitely extended lines thereof being in a range of 0 degrees±2 degrees to allow for manufacturing error and the like. The length of each fine groove 3 may be greater than or equal to the length of the score line 2 closest to that fine groove 3. In the case of the present embodiment, each fine groove 3 is an unbroken single groove, but some or all of the plurality of fine grooves 3 may be partially broken.

In the case of the present embodiment, the fine grooves 4 are linear grooves extending in a direction (d1 direction) orthogonal to the score lines 2. Here, the direction orthogonal to the score lines 2 may include the angle of intersection of the score lines 2 and extended lines of the fine grooves 4 being in a range of 90 degrees±2 degrees to allow for manufacturing error and the like. The length of the fine grooves 4 may be a length that approximates the spacing between adjacent score lines 2 (pitch of the score lines 2) in a range that does not project into the score lines 2. In the case of the present embodiment, each fine groove 4 is an unbroken single groove, but some or all of a plurality of fine grooves 4 may be partially broken.

In the case of the present embodiment, the fine grooves 3 and the fine grooves 4 intersect each other orthogonally, and the spaces within the grooves communicate with each other. However, a configuration in which the fine grooves 3 and the fine grooves 4 do not communicate can also be employed.

The fine grooves 3 have a depth D1 and a width W1. The depth D1 is the distance between the deepest part of the fine grooves 3 and the surface of the face portion 1. The width W1 is the distance between both edges of the fine grooves 3 in a direction orthogonal to the direction (here, d2 direction) in which the fine grooves 3 extend. In the case of the present embodiment, the relationship between the depth D1 and the width W1 is W1>D1. That is, the cross section of the fine grooves 3 (the direction orthogonal to the direction in which the grooves extend is taken as the cross section; the same applies to the fine grooves 4 below) has a comparatively flat shape in which the width W1 is longer than the depth D1. The surface of the golf ball thereby tends to bite into the fine grooves 3 at impact, enabling the amount of spin to be increased. In particular, in the case of the present embodiment, given that the fine grooves 3 extend in the d2 direction, the upper edge of the fine grooves 3 tends to hold the golf ball in the d1 direction, enabling the amount of spin on the ball to be increased.

The depth D1 is, for example, from 10 μm to 30 μm inclusive. With a golf club head for competitive use, there are certain restrictions regarding the surface roughness of the striking face, and the maximum height (Ry) is 25 μm or less. Accordingly, in the case where the golf club head A is for competitive use, the depth D1 is from 10 μm to 25 μm inclusive. The width W1 is, for example, from 100 μm to 800 μm inclusive, and preferably from 200 μm to 600 μm inclusive. The ratio of the depth D1 and the width W1 is, for example, within the following range: D1:W1=1:3.4 to 1:80. The pitch between adjacent fine grooves 3 may be equal or may be different. The pitch is, for example, from 100 μm to 1500 μm inclusive, and preferably from 200 μm to 1000 μm inclusive.

In the case of the present embodiment, the cross section of the fine grooves 3 has a U-shape in which the contour of the bottom portion thereof has a circular arc shape or an elliptical arc shape. As a result of the fine grooves 3 having a U-shaped cross section, both edges of the fine grooves 3 in the d1 direction can be formed at a comparatively acute angle, enabling the amount of spin of the golf ball to be increased at impact. The cross section of the fine grooves 3 is not limited to being U-shaped, and may, for example, have a triangular shape, rectangular shape or a trapezoidal shape.

The fine grooves 4 have a depth D2 and a width W2. The depth D2 is the distance between the deepest part of the fine grooves 4 and the surface of the face portion 1. The width W2 is the distance between both edges of the fine grooves 4 in a direction orthogonal to the direction (here, d1 direction) in which the fine grooves 4 extend. In the case of the present embodiment, the relationship between the depth D2 and the width W2 is W2<D2. That is, the cross section of the fine grooves 4 has a comparatively elongated shape in the depth direction in which the depth D2 is longer than the width W2. Capillary action thereby works better, water on the face portion 1 drains better through the fine grooves 4, and the effect of suppressing a reduction in the amount of backspin improves at times such as in wet weather.

The depth D2 is from 11 μm to 50 μm inclusive, and, in the case where the golf club head A is for competitive use, the depth D2 is 25 μm or less, in terms of the rules regarding the surface roughness of the striking face. The width W2 is, for example, from 10 μm to 49 μm inclusive, and preferably from 15 μm to 30 μm inclusive. The ratio of the depth D2 and the width W2 is, for example, within the following range: D2:W2=1:0.2 to 1:0.98. The pitch between adjacent fine grooves 4 may be equal or may be different. The pitch is, for example, from 300 μm to 1000 μm inclusive, and preferably from 400 μm to 800 μm inclusive.

In the case of the present embodiment, the cross section of the fine grooves 4 has a triangular shape, and, in particular, an isosceles triangular shape (V-shaped). As a result of the cross section of the fine grooves 4 having an isosceles triangular shape, the fine grooves 4 are less susceptible to becoming clogged with grass and other foreign matter, in addition to being able to form smaller water channels to facilitate capillary action. The cross section of the fine grooves 4 is not limited to being triangular, and may, for example, have a rectangular shape or a trapezoidal shape.

The dimensional relationship between the fine grooves 3 and the fine grooves 4 will now be compared. In the case of the present embodiment, the relationship between a cross-sectional area S1 of the cross section of the fine grooves 3 and a cross-sectional area S2 of the cross section of the fine grooves 4 is S1>S2. The golf ball bites in better due to the cross-sectional area S1 being relatively large, and drainage through capillary action can be improved due to the cross-sectional area S2 being relatively small. The ratio of the cross-sectional area S1 and the cross-sectional area S2 is, for example, within the following range: S1:S2=1:0.004 to 1:0.99. From a similar viewpoint, the relationship between the width W1 and the width W2 is preferably W1>W2, and the ratio of the width W1 and the width W2 is, for example, preferably within the following range: W1:W2=1:0.013 to 1:0.49. Also, the relationship between the depth D1 and the depth D2 is preferably D1<D2, and the ratio of the depth D1 and the depth D2 is, for example, within the following range: D1:D2=1:1.03 to 1:3.

In the present embodiment as described above, by forming two types of fine grooves 3 and 4 having different width-depth relationships, an increase in the amount of backspin can thus be combined with the effect of suppressing a reduction in the amount of backspin at times such as in wet weather due to improved drainage. That is, improvement in the drainage on the face portion 1 and in the amount of spin on the ball can be achieved.

Figure 5A:
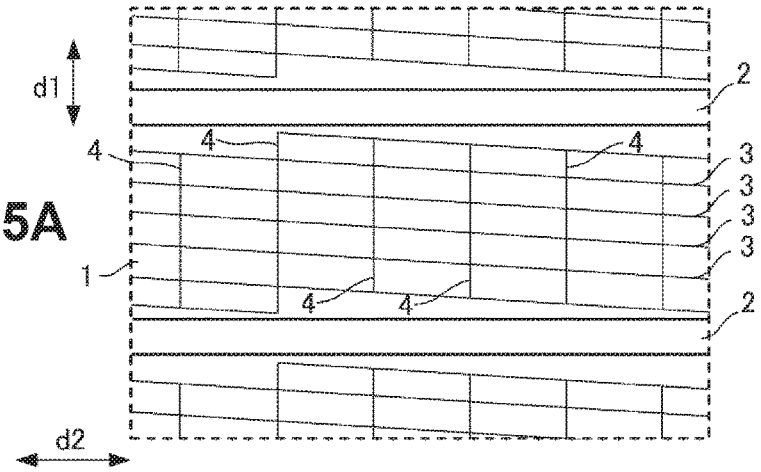
FIGS. 5A to 5C are diagrams showing other examples of grooves.
Figure 5B:
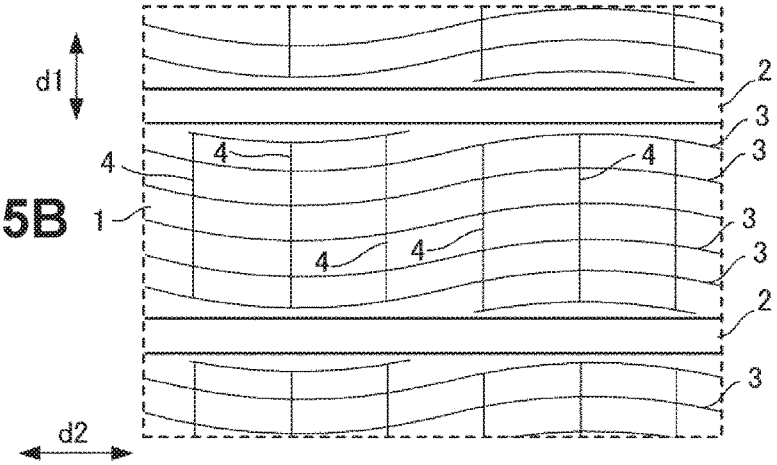
Figure 5C:
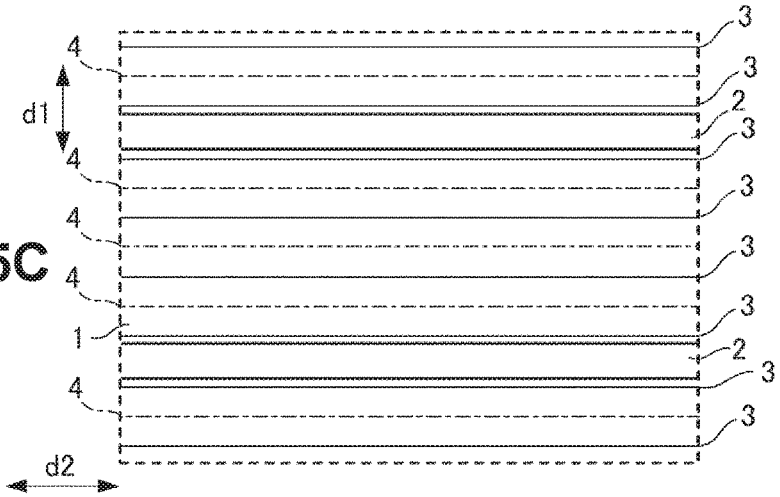

Examples of other modes of the fine grooves 3 and the fine grooves 4 will now be described with reference to FIGS. 5A to 5C. Although the fine grooves 3 are configured as grooves that are parallel to the score lines 2 in the example of FIG. 1, they may be grooves that slope relative to the score lines 2. FIG. 5A shows an example of such a configuration, with the fine grooves 3 in the diagram sloping relative to the score lines 2. The direction of the slope of the fine grooves 3 may be a direction at which the angle of intersection of the fine grooves 3 and the direction of the flight path of the ball approximates 90 degrees, in the case where the face portion 1 is open at address. Although not illustrated, the fine grooves 4 may slope from the d1 direction.

Next, the fine grooves 3 are configured as grooves that are parallel to the linear score lines 2 in the example of FIG. 1, but may be grooves that extends in a curving manner in the d2 direction or grooves that extends in a snaking manner in the d2 direction. FIG. 5B shows an example of such a configuration, with the fine grooves 3 in the diagram extending in the d2 direction in a repeated wave pattern. Although not illustrated, the fine grooves 4 may extend in the d1 direction in a curving or winding manner.

Next, although the fine grooves 4 are configured to extend in a direction orthogonal to the fine grooves 3 in the example of FIG. 1, they may slope or extend parallel to the fine grooves 3. FIG. 5C shows an example of such a configuration. The fine grooves 4 in the diagram extend in the d2 direction, and extend parallel to the fine grooves 3. Although the fine grooves 3 and the fine grooves 4 are formed alternately in the d1 direction, a plurality of fine grooves 3 may be formed continuously in the d1 direction, or conversely a plurality of fine grooves 4 may be formed continuously in the d1 direction.

Figure 6A:
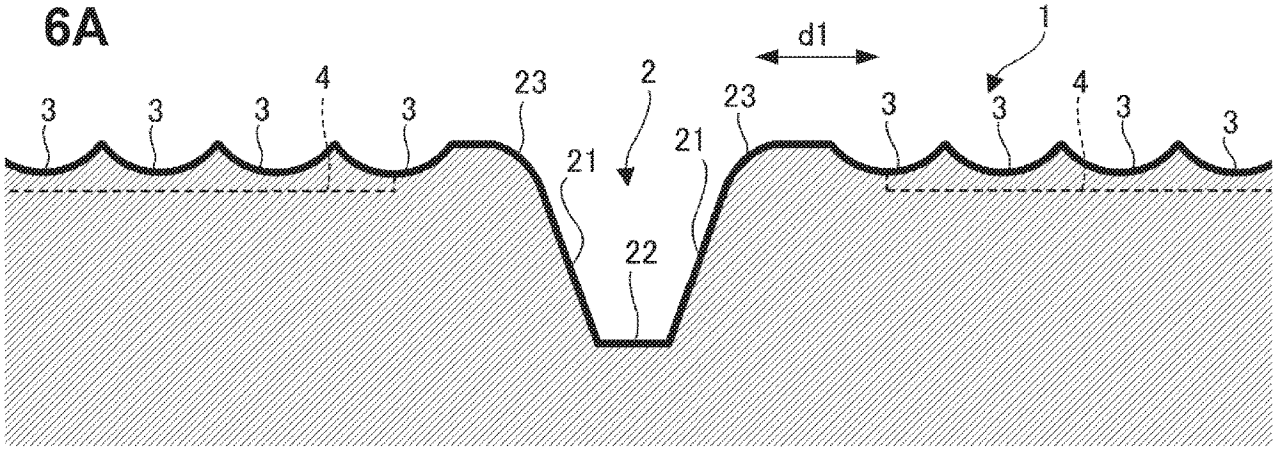
FIGS. 6A and 6B are diagrams showing examples of other modes of the grooves.

Other working examples of the fine grooves 3 will be described with reference to FIGS. 6A and 6B. Although a flat portion is interposed between the fine grooves 3 that are adjacent in the d1 direction in the example of FIGS. 2 and 3A, the fine grooves 3 may be continuously formed in the d1 direction without a flat portion being interposed therebetween. FIG. 6A shows an example of such a configuration. In the example of FIG. 6A, the pitch of the fine groove 3 in the d1 direction is configured to match the width W1 of the fine grooves 3. There is thus no flat portion between the fine grooves 3 that are adjacent in the d1 direction. In this example, the number of the fine grooves 3 can be increased, and the boundary portions of the fine grooves 3 that are adjacent in the d1 direction are pointed protruding portions, enabling the amount of spin on the golf ball to be increased.

Figure 6B:
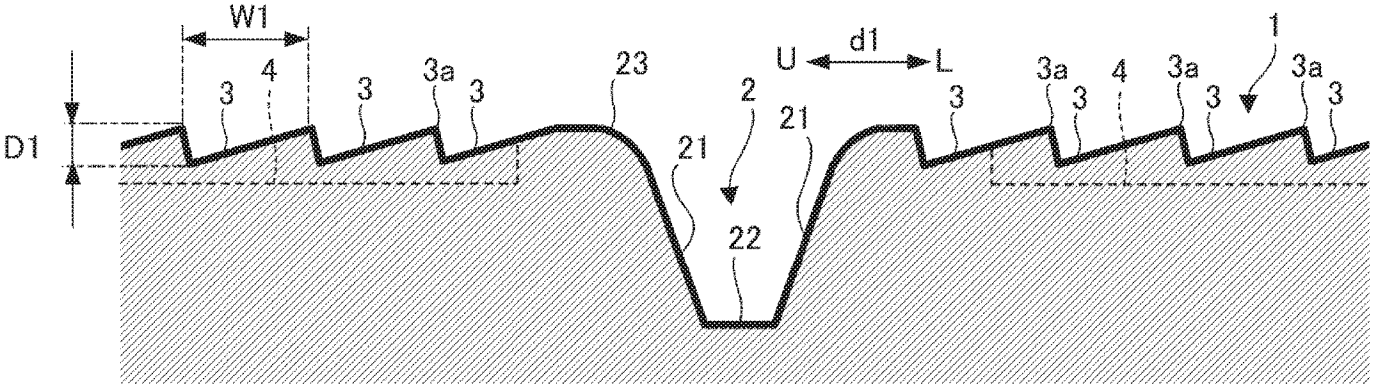

FIG. 6B illustrates another cross-sectional shape of the fine grooves 3, and in the example of this diagram, the cross-section has a triangular shape, and, in particular, a scalene triangular shape in which the three interior angles are different. In the example of FIG. 6B, an upper edge portion 3*a* in the d1 direction is formed at an acute angle, thus improving the hold on the golf ball at impact, and enabling the amount of spin to be increased.

Next, methods of forming the fine grooves 3 and the fine grooves 4 will be described. The golf club head A is manufactured by, for example, forging or casting a primary molded article that does not have the fine grooves 3 and the fine grooves 4. Next, the fine grooves 3 and the fine grooves 4 are formed in the primary molded article. Thereafter, coating and surface treatments are performed to complete the golf club head A. The primary molded article may or may not have the score lines 2 formed therein. In the case where there the primary molded article does not have the score lines 2, the score lines 2 can also be formed at the time that the fine grooves 3 and the fine grooves 4 are formed. The primary molded article may be a single member or may be a plurality of members. In the case where the primary molded article is a plurality of members, the primary molded article may, for example, be constituted by a face formation member that forms the face portion 1 and a head main body that forms portions other than the face portion 1. In this case, the face formation member and the head main body may be assembled, after forming the fine grooves 3 and the fine grooves 4 in the face formation member.

Figure 7A:
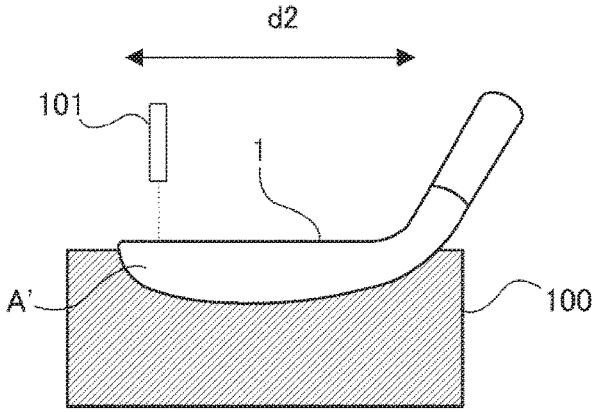
FIGS. 7A to 7C are diagrams showing examples of manufacturing methods.
Figure 7B:
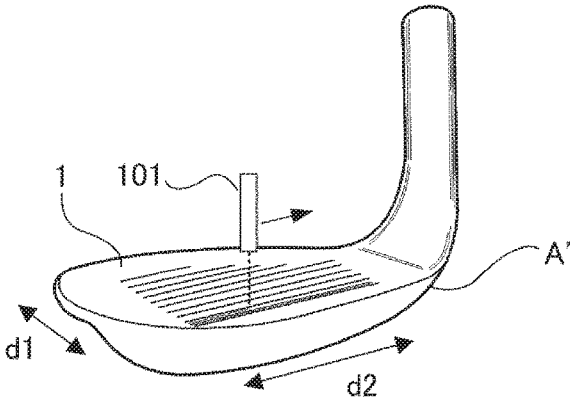

The fine grooves 3 and the fine grooves 4 can be formed by laser processing or cutting. FIGS. 7A and 7B illustrate the case where the fine grooves 3 and the fine grooves 4 are formed by laser processing. A primary molded article A' in which the fine grooves 3 and the fine grooves 4 are not formed is fixed to a laser irradiation apparatus which is not shown via a jig 100. The laser irradiation apparatus has an irradiation unit 101 that irradiates a laser beam. The fine grooves 3 are formed by moving the face portion 1 (primary molded article A') and the irradiation unit 101 relative to each other in the d2 direction, while the face portion 1 is being irradiated with a laser beam by the irradiation unit 101. Also, the fine grooves 4 are formed by moving the face portion 1 (primary molded article A') and the irradiation unit 101 relative to each other in the d1 direction, while the face portion 1 is being irradiated with a laser beam by the irradiation unit 101. Note that the fine grooves 3 may be formed after forming the fine grooves 4, and the order in which the fine grooves 3 and the fine grooves 4 are formed is not limited.

Figure 7C:
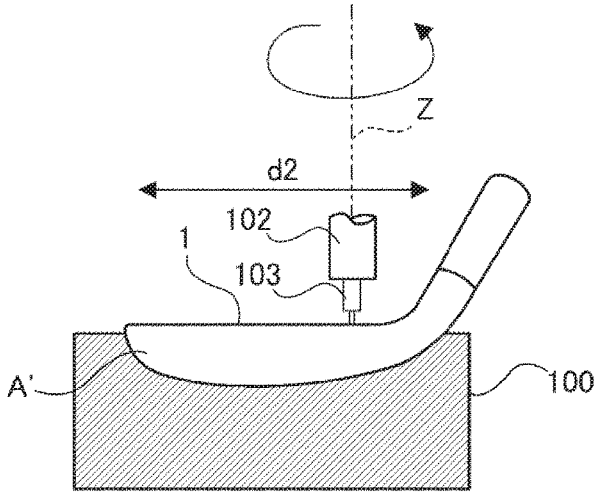

FIG. 7C illustrates the case where the fine grooves 3 and the fine grooves 4 are formed by cutting. The primary molded article A' is fixed to an NC milling machine via a jig 100. The NC milling machine has a spindle 102 that is rotationally driven about a Z-axis, and a cutting tool (end mill) 103 is attached to the lower end of the spindle 102. The fine grooves 3 are formed by moving the face portion 1 (primary molded article A') and the cutting tool 103 relative to each other in the d2 direction, similarly to the case of laser processing. Also, the fine grooves 4 are formed by moving the face portion 1 (primary molded article A') and the cutting tool 103 relative to each other in the d1 direction.

Note that the formation method may be differentiated between the fine grooves 3 and the fine grooves 4. For example, the fine grooves 3 may be formed by cutting, and the fine grooves 4 may be formed by laser processing. Laser processing with a laser having a short pulse width may be preferable for the fine grooves 4, thereby suppressing the thermal effect of laser irradiation, and facilitating the formation of grooves having a smaller width W2.

Note that a surface treatment for increasing the hardness of the face portion 1 is preferably performed, after the formation of the fine grooves 3 and the fine grooves 4. Carburizing, nitriding, nitrocarburizing, physical vapor deposition (PVD), ion plating, diamond-like carbon (DLC) treatment, plating and the like are given as examples of such a surface treatment. In particular, a surface treatment that modifies the surface, rather than forming another metal layer on the surface, such as carburizing or nitriding, is preferable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-121720, filed Jun. 21, 2017, which is hereby incorporated by reference herein in its entirety.

What is claimed is:

1. A golf club head including a face portion, comprising:

a plurality of score lines formed on the face portion;

a plurality of first grooves formed on the face portion; and a plurality of second grooves formed on the face portion, wherein the first grooves have a depth D1 and a width W1 that is in a direction orthogonal to a direction in which the first grooves extend, the second grooves have a depth D2 and a width W2 that is in a direction orthogonal to a direction in which the second grooves extend, W1>D1, and

W2<D2.

2. The golf club head according to claim 1, wherein a cross section of the first grooves in the direction orthogonal to the direction in which the first grooves extend has a scalene triangular shape, and a cross section of the second grooves in the direction orthogonal to the direction in which the second grooves extend has an isosceles triangular shape.

3. The golf club head according to claim 1, wherein D1<D2.

4. The golf club head according to claim 1, wherein S1>S2, when an area of a cross section of the first grooves in the direction orthogonal to the direction in which the first grooves extend is given as S1, and an area of a cross section of the second grooves in the direction orthogonal to the direction in which the second grooves extend is given as S2.

5. The golf club head according to claim 1, wherein the first grooves extend in a toe-heel direction, and the second grooves extend in a direction orthogonal to the score lines.

6. The golf club head according to claim 5, wherein the first grooves extend parallel to the score lines.

* * * * *